US008292104B2

(12) United States Patent
Cheng

(10) Patent No.: US 8,292,104 B2
(45) Date of Patent: Oct. 23, 2012

(54) SAFETY BOTTLE CAP STRUCTURE WITH ANTI-BURGLARY TEARING FLANGE

(75) Inventor: Chun-Hsiang Cheng, Taichung (TW)

(73) Assignee: Living Fountain Plastic Industrial Co., Ltd., Taichung (TW)

( * ) Notice: Subject to any disclaimer, the term of this patent is extended or adjusted under 35 U.S.C. 154(b) by 116 days.

(21) Appl. No.: 13/026,406

(22) Filed: Feb. 14, 2011

(65) Prior Publication Data

US 2012/0205338 A1 Aug. 16, 2012

(51) Int. Cl.
*B65D 41/32* (2006.01)

(52) U.S. Cl. ..... 215/256; 215/228; 215/253; 215/254; 220/212; 220/266; 220/270

(58) Field of Classification Search ..... 215/256, 215/252, 274, 253, 258, 250; 220/268, 266, 220/265

See application file for complete search history.

(56) References Cited

U.S. PATENT DOCUMENTS

| | | | | | |
|---|---|---|---|---|---|
| 3,784,041 | A * | 1/1974 | Birch | ..... | 215/256 |
| 4,478,343 | A * | 10/1984 | Ostrowsky | ..... | 215/252 |
| 4,830,208 | A * | 5/1989 | Osting et al. | ..... | 215/252 |
| 5,727,705 | A * | 3/1998 | Kelly | ..... | 215/252 |
| 5,984,124 | A * | 11/1999 | Takano | ..... | 215/252 |

* cited by examiner

*Primary Examiner* — Sam Yao
*Assistant Examiner* — Don M Anderson
(74) *Attorney, Agent, or Firm* — Egbert Law Offices, PLLC

(57) ABSTRACT

A safety bottle cap for preventing damage from anti-burglary tearing flanges has an opening, a cover and a two-layer tear ring between the opening and the aperture on the cover. A lower stop flange is protruded on the lower section of the opening. An upper stop flange is located at a spacing with the lower stop flange. A hooking edge is protruded on the inner side of the aperture. The tear ring has upper and lower rings, ribs arranged to link the rings, an outward flange protruded on exterior of the upper ring, an upper abutting edge protruded on the inner side of the upper ring and a lower abutting edge protruded on the inner side of the lower ring. The safety bottle cap allows the cover to be opened smoothly without spurs on the aperture, thus realizing anti-burglary identification and improving protection against mouth injury.

4 Claims, 8 Drawing Sheets

SAFETY BOTTLE CAP STRUCTURE WITH ANTI-BURGLARY TEARING FLANGE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a safety bottle cap, and more particularly to an innovative one which is configured to prevent damage with an anti-burglary tearing flange.

2. Description of Related Art Including Information Disclosed Under 37 CFR 1.97 and 37 CFR 1.98

In order to prevent the possible personal injury arising from manually opening the bottle cap, a variety of currently available bottled products (e.g., beverage, mineral water and mouthwash) are generally fitted with anti-burglary safety bottle caps.

Such anti-burglary safety bottle caps are structured differently, but mainly designed in such a way to link the opening of the bottle cap with an anti-burglary tearing flange. Said anti-burglary tearing flange and the bottle cap are linked by spacing ribs. A snap stopper is often set at inner side of the anti-burglary tearing flange. When the bottle cap is screwed loose, the spacing ribs linked between the anti-burglary tearing flange and bottle cap will be torn, allowing to judge if the bottle cap is opened for anti-burglary identification.

However, the following shortcomings of conventional anti-burglary safety bottle cap are still found during actual applications:

Generally speaking, the caps of bottled products are not used as cups by the users due to very small volume, but if users drink mouthwash, it is possible to cause excessive drinking amount. In fact, only about 10 milliliters of mouthwash is required every time. Due to such features, the bottle cap of mouthwash product is perfectly suited for such requirement, so the bottle cap is extensively used to accommodate mouthwash. According to the structural design of the prior art, mouth injury may often occur if the users drink the mouthwash from the opening of the bottle cap. This is because spacing spurs (i.e.: residues at torn position of spacing ribs) are often generated at the opening of the bottle cap after the anti-burglary tearing flange and the bottle cap bottom are torn off. In such a case, the mouth of the users is vulnerable to the spurs of the bottle cap, especially in cold or dry regions.

Thus, to overcome the aforementioned problems of the prior art, it would be an advancement if the art to provide an improved structure that can significantly improve the efficacy.

Therefore, the inventor has provided the present invention of practicability after deliberate experimentation and evaluation based on years of experience in the production, development and design of related products.

BRIEF SUMMARY OF THE INVENTION

The enhanced efficacy of the present invention is as follows:

Based on the unique structural configuration of the "safety bottle cap" of the present invention wherein a two-layer tear ring is sleeved between the lower section of the opening and the inner side of the aperture on the cover, when the cover is opened, the connecting ribs linked between the upper and lower rings are torn off, such that the upper and lower rings of two-layer tear ring are separated to ensure a smooth aperture. Hence, the safety bottle cap of the present invention features anti-burglary identification function and improved degree of protection against mouth injury.

The improvements brought about by this invention are as follow:

Based on the structural configuration wherein the top wall of said cover is provided with flange ring, the flange ring is abutted onto the inner side of the top of the opening to improve the leakage resistance effect.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
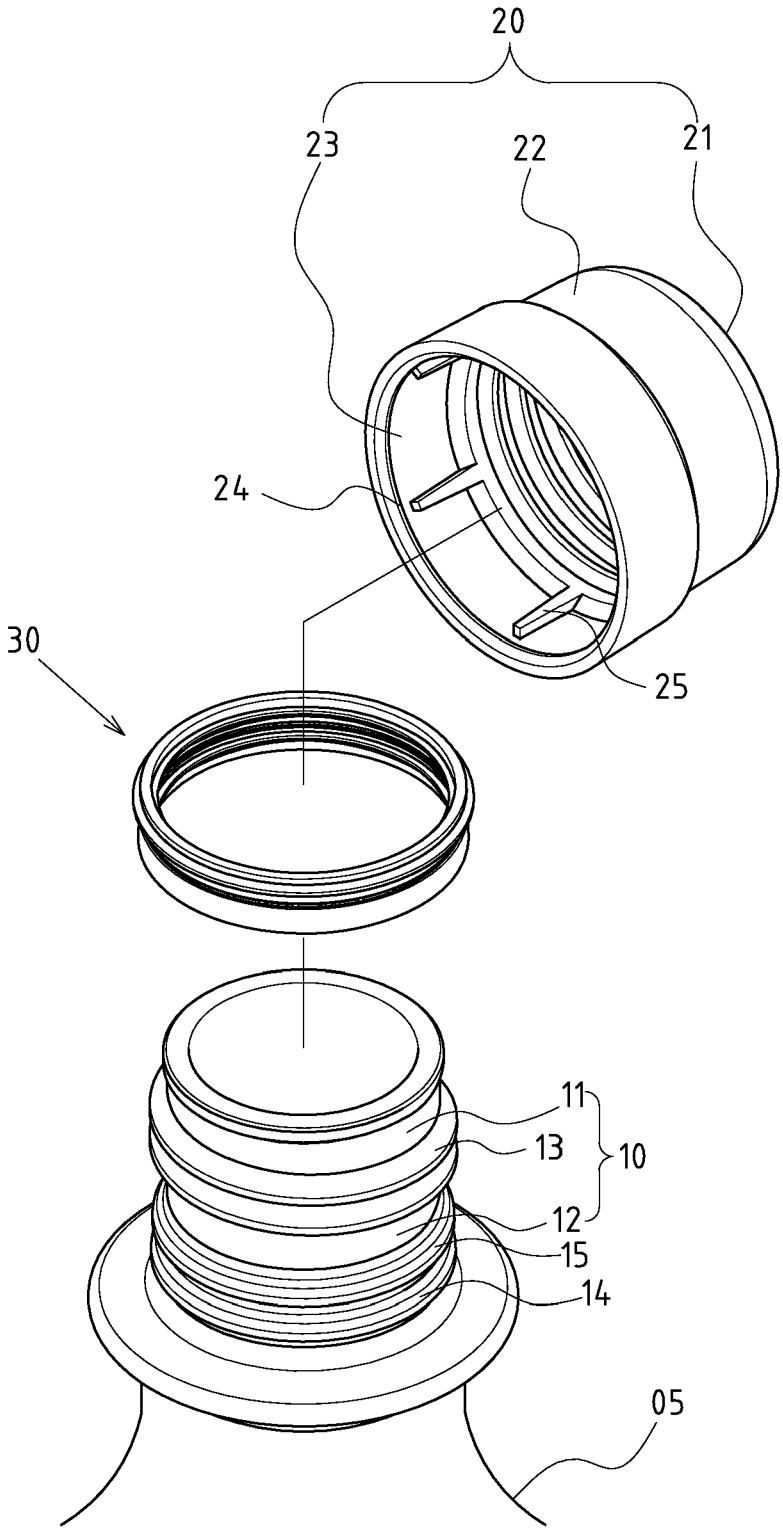
FIG. 1 is a perspective view showing assembly relationship of the preferred embodiment of the present invention.
Figure 2:
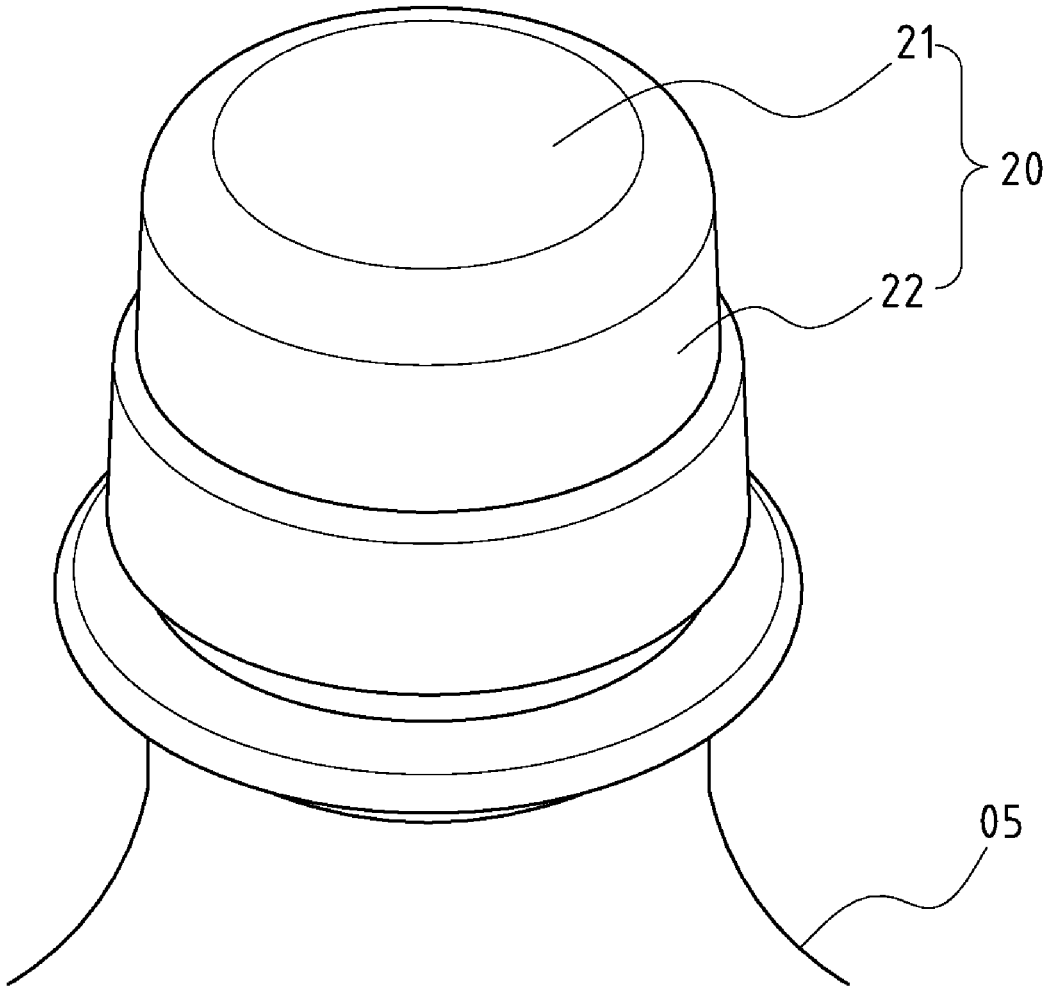
FIG. 2 is an assembled perspective view of the preferred embodiment of the present invention.
Figure 3:
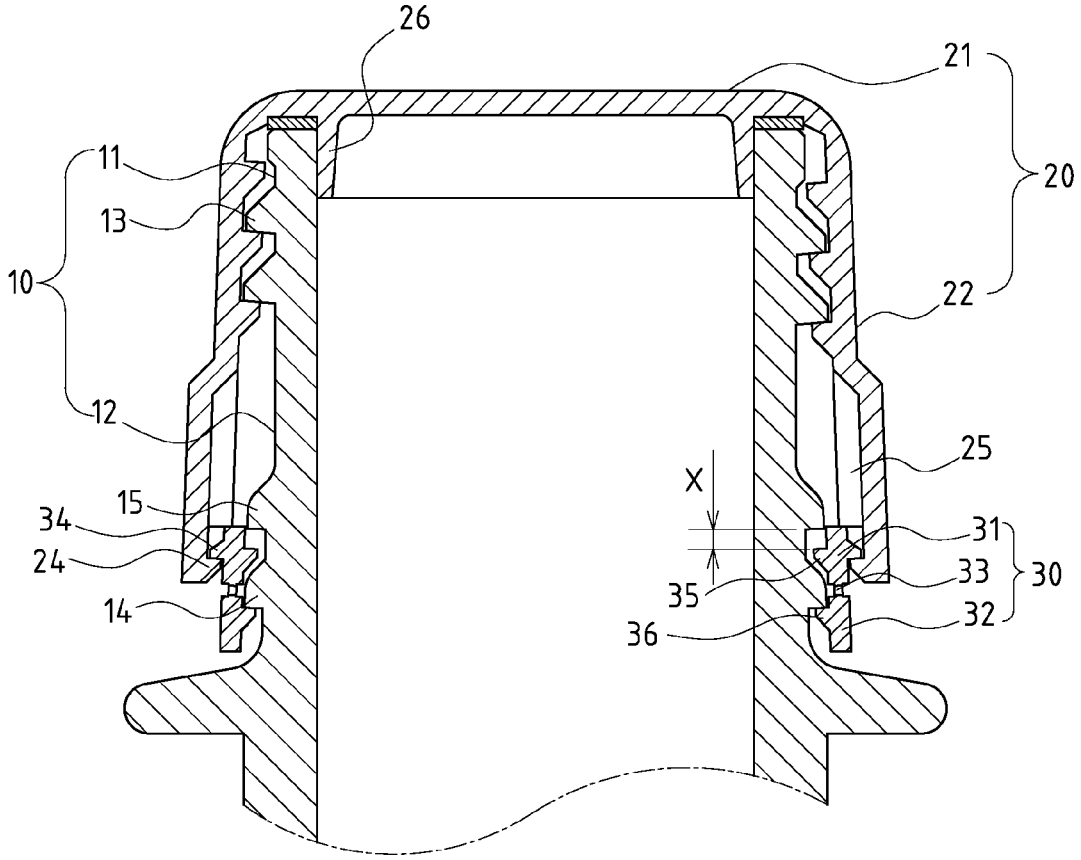
FIG. 3 is an assembled plan view of the preferred embodiment of the present invention.
Figure 4:
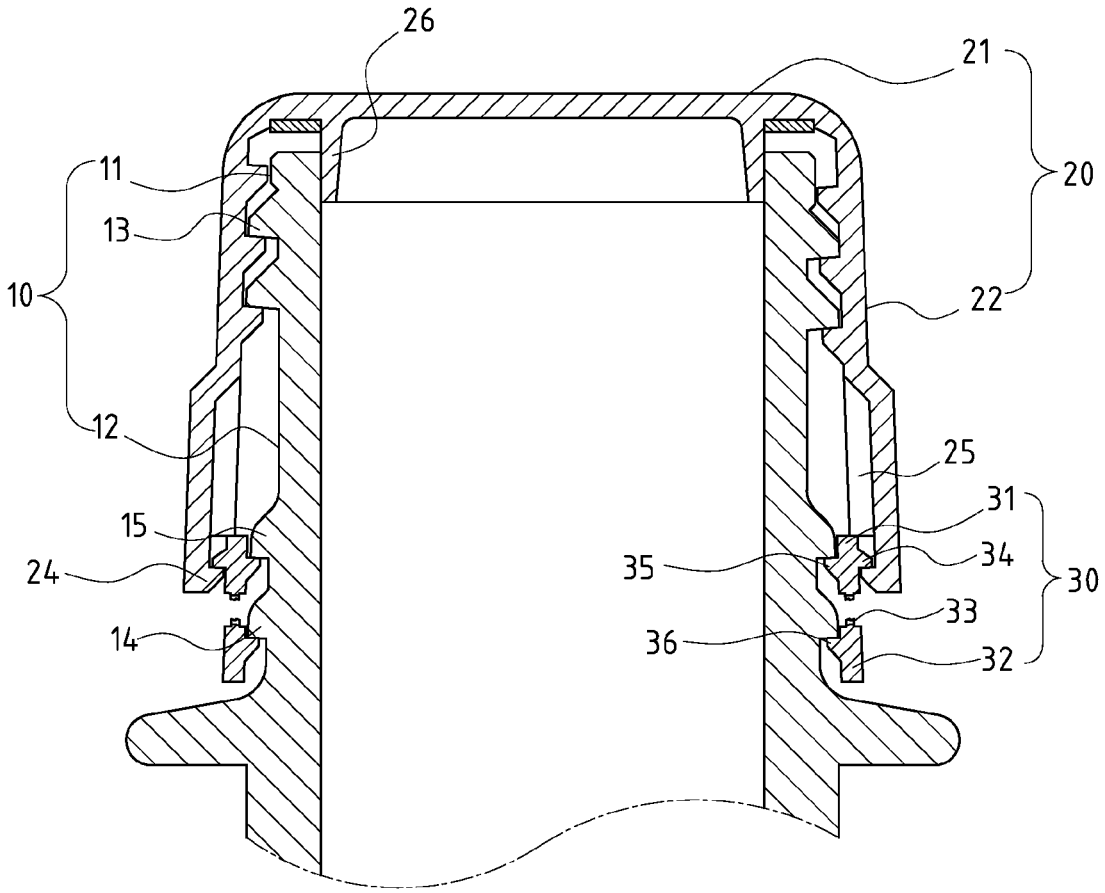
FIG. 4 is a plan view showing that the connecting ribs of the present invention are torn.

FIGS. 1-4 depict preferred embodiments of a safety bottle cap of the present invention with anti-burglary tearing flange, which, however, are provided for only explanatory objective for patent claims.

Said safety bottle cap includes an opening 10, formed on top section of a bottle 05 in a hollow tubing state. The exterior of the opening 10 comprises of an upper section 11 and a lower section 12, of which the upper section 11 is provided with a screwed portion 13.

A lower stop flange 14 is protruded on the lower section 12 of the opening 10.

An upper stop flange 15 is protruded on the lower section 12 of the opening 10 and also located at a spacing with the lower stop flange 14.

Figure 7:
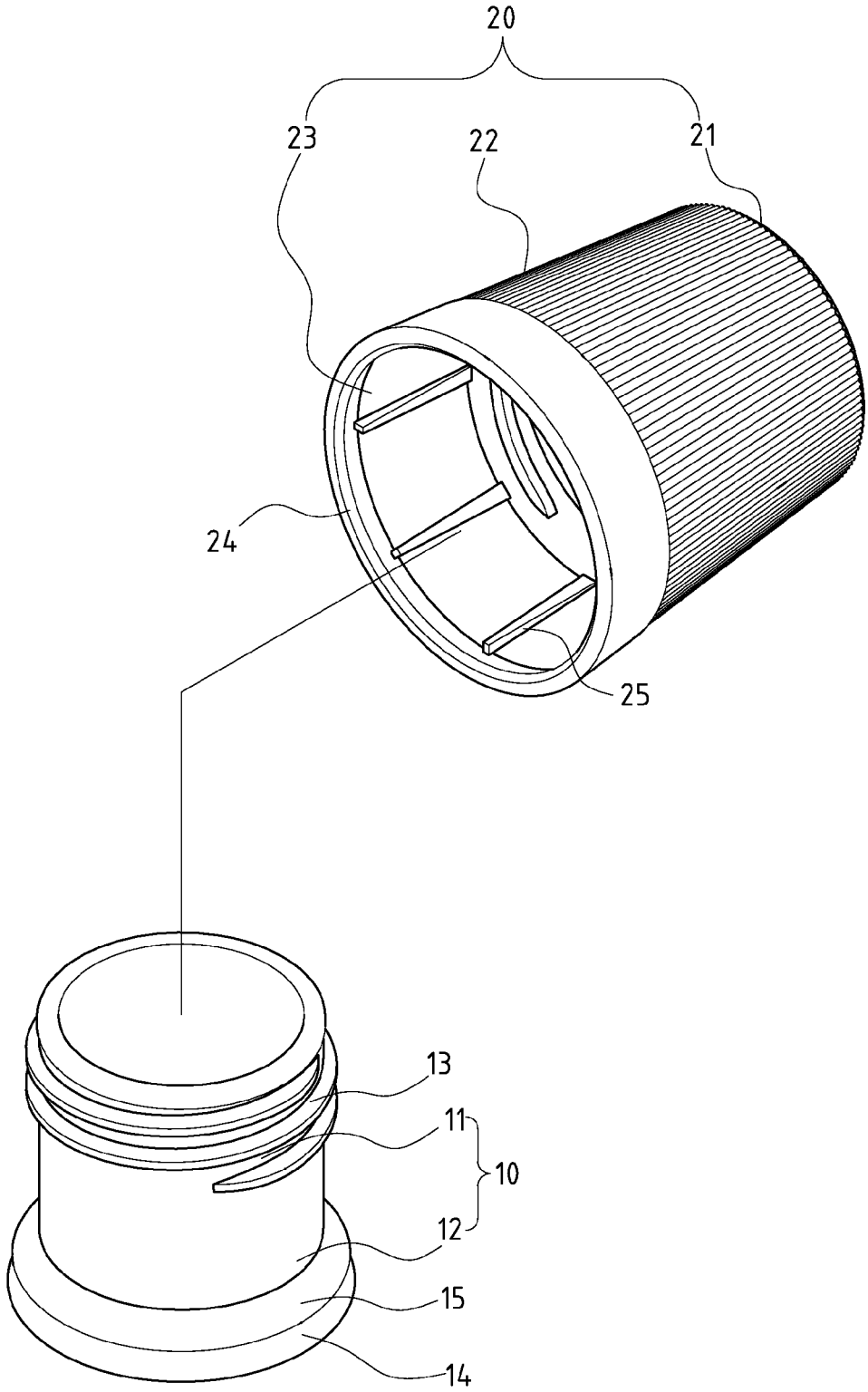
FIG. 7 is a perspective view of another preferred embodiment of the cover of the present invention.
Figure 8:
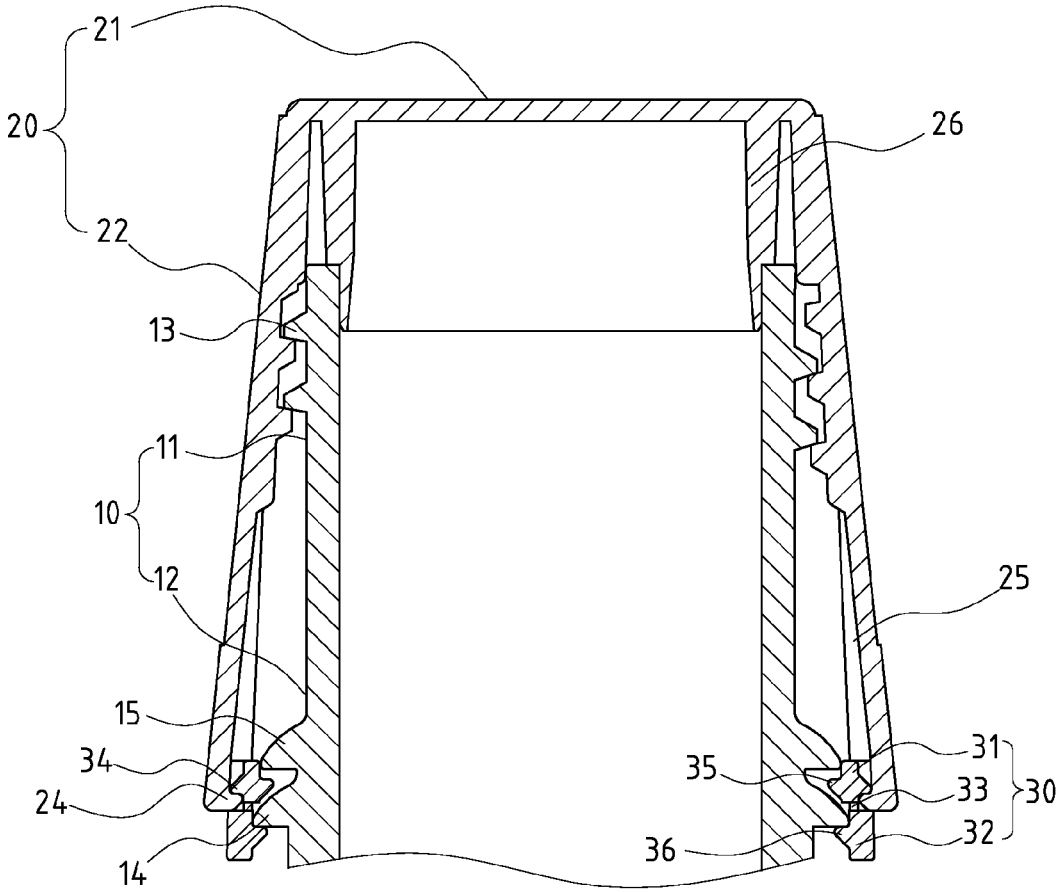
FIG. 8 is a plan view of another preferred embodiment of the cover of the present invention.

A cover 20 is defined into a hollow casing composed of a top wall 21, a side wall 22 and an aperture 23 at bottom of the side wall 22. The cover 20 is available with a tapered pattern (disclosed in FIGS. 7, 8).

A hooking edge 24 is protruded on the inner side of the aperture 23 on the cover 20, and also located between the upper and lower stop flanges 14, 15.

A two-layer tear ring 30 is sleeved between the lower section 12 of the opening 10 and the inner side of the aperture 23 on the cover 20. The two-layer tear ring is composed of an upper ring 31, annularly sleeved onto a position correspondingly to the upper and lower stop flanges 15, 14. A lower ring 32 is annularly sleeved onto a position correspondingly to the lower stop flange 14. Multiple connecting ribs 33 are arranged at interval to link the upper ring 31 and lower ring 32. An outward flange 34 is protruded on exterior of the upper ring 31, and hooked upwards by the hooking edge 24. An upper abutting edge 35 is protruded on the inner side of the upper ring 31 and extended into the spacing of the upper and lower stop flanges 15, 14. A shift spacing X is reserved between the upper abutting edge 35 and upper stop flange 15, enabling the upper abutting edge 35 to shift along the shift spacing X. A lower abutting edge 36 is protruded on the inner side of the lower ring 32 and abutted upwards onto the lower stop flange 14.

Of which, the side wall 22 of the cover 20 is provided with a limit lug 25 at a spacing over the hooking edge 24, allowing to abut downwards onto the top of the upper ring 31 of the two-layer tear ring 30.

Of which, the top wall 21 of the cover 20 is provided with a flange ring 26, allowing it to abut onto the inner side of the top of the opening 10 to improve the leakage resistance effect.

Of which, the upper/lower stop flanges 15, 14 as well as the outward flange 34 and upper/lower abutting edges 35, 36 of the two-layer tear ring 30 are of either annular or spaced patterns.

Figure 5:
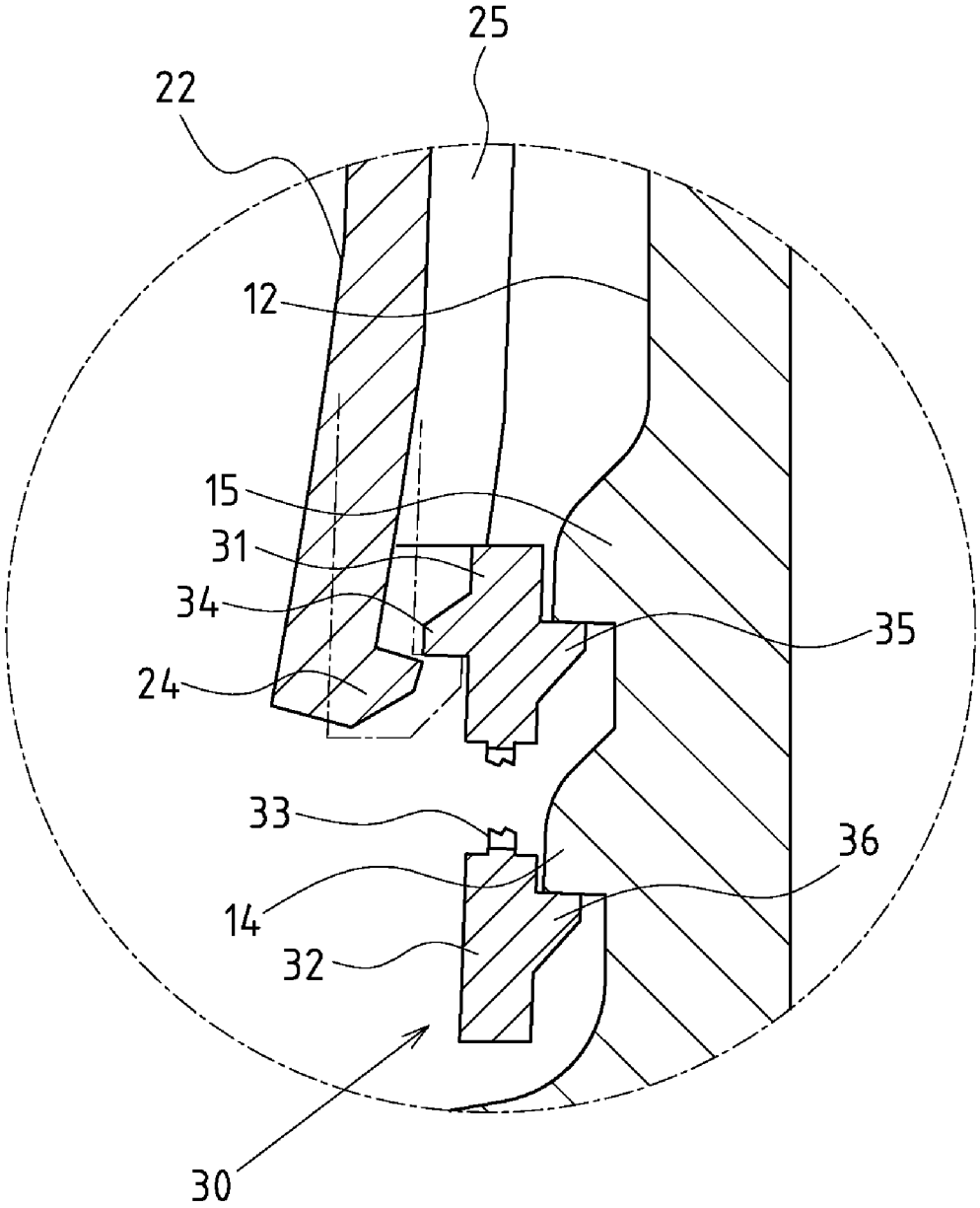
FIG. 5 is a partially enlarged view of FIG. 4.
Figure 6:
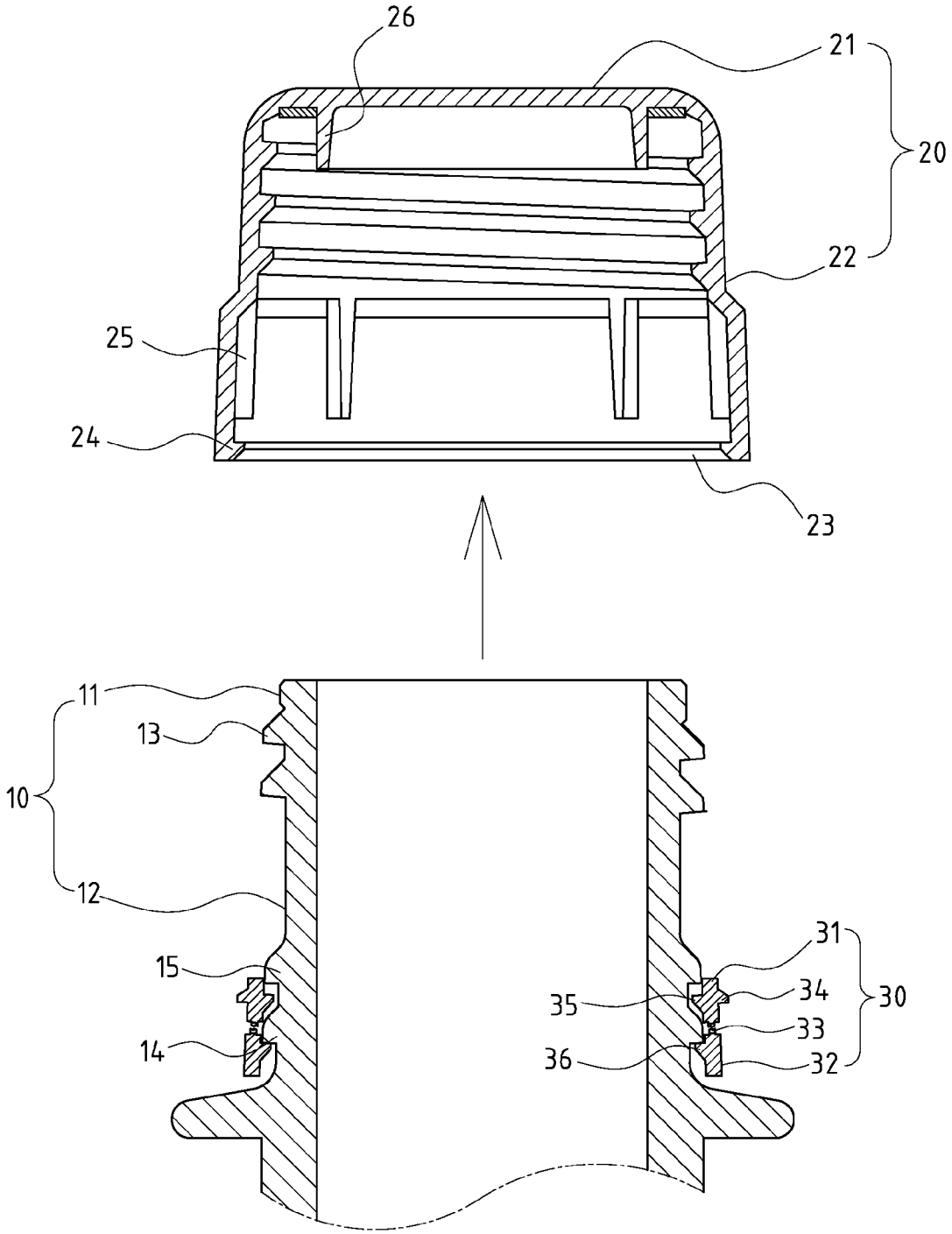
FIG. 6 is a plan view wherein the bottle cap of the present invention is opened.

Hence, the core feature of the safety bottle cap of the present invention lies in that, a two-layer tear ring 30 is sleeved between the lower section 12 of the opening 10 and the inner side of the aperture 23 on the cover 20. When the cover 20 is screwed loose, the lower abutting edge 36 on the lower ring 32 of the two-layer tear ring 30 is abutted upwards onto the lower stop flange 14 of the opening 10, such that the upper ring 31 of the two-layer tear ring 30 is driven by the cover 20 to shift upwards, and the connecting ribs 33 linked between the upper ring 31 and lower ring 32 are torn (disclosed in FIG. 4). In such a case, the upper ring 31 and lower ring 32 of two-layer tear ring 30 are separated. When the upper abutting edge 35 of the upper ring 31 shifts upwards along the shift spacing X to abut onto the upper stop flange 15, said hooking edge 24 is disengaged from the outward flange 34 (disclosed in FIG. 5), so said cover 20 (disclosed in FIG. 6) is opened, thus resolving the problem of spurs on the conventional bottle cap. With the setting of two-layer tear ring 30, the safety bottle cap of the present invention allows the cover 20 to be opened smoothly without spurs on the aperture 23, thus realizing burglary prevention and improving the protection degree of the safety bottle cap.

I claim:

1. An apparatus comprising a bottle and a safety bottle cap configuration:

wherein said bottle comprises an opening, formed on top section of a bottle in a hollow tubing state; the exterior of the opening comprises of an upper and a lower section, of which the upper section is provided with a screwed portion;

a lower stop flange, protruded on the lower section of the opening;

an upper stop flange, protruded on the lower section of the opening and also located at a spacing with the lower stop flange;

wherein said safety bottle cap comprises a cover, defined into a hollow casing composed of a top wall, a side wall and an aperture at bottom of the side wall;

a hooking edge, protruded on the inner side of the aperture on the cover, and also located between the upper and lower stop flanges;

a two-later tear ring, sleeved between the lower section of the opening and the inner side of the aperture on the cover, comprising:

an upper ring, annularly sleeved onto a position correspondingly to the upper and lower stop flanges;

a lower ring, annularly sleeved onto a position correspondingly to the lower stop flange;

multiple connection ribs, arranged at interval to link the upper and lower rings;

an outward flange, protruded on exterior of the upper ring, and hooked upwards by the hooking edge;

an upper abutting edge, protruded on the inner side of the upper ring and extended into the spacing of the upper and lower stop flanges;

a lower abutting edge, protruded on the inner side of the lower ring and abutted upwards onto the lower stop flange;

of which, a shift spacing is reserved between the upper abutting edge and upper stop flange;

wherein when the cover is screwed loose, the lower abutting edge on the lower ring is abutted upwards onto the lower stop flange of the opening such that the upper ring is driven by the cover to shift upwards and the connecting ribs are torn off so as to separate the upper and lower rings wherein when the upper abutting edge of the upper ring shifts upwards along the shift spacing to abut onto the upper stop flange such that said hooking edge is disengaged from the outward flange, so said cover is opened.

2. The apparatus defined in claim 1, wherein the side wall of the cover is provided with a limit lug at a spacing over the hooking edge, allowing to abut downwards onto the top of the upper ring of the two-layer tear ring; the cover can be covered onto the opening, allowing two-layer tear ring to be sleeved between the lower section of the opening and the inner side of the cover's aperture.

3. The apparatus defined in claim 1, wherein the top wall of said cover is provided with a flange ring, which is abutted onto the inner side of the top of the opening to improve the leakage resistance effect.

4. The apparatus defined in claim 1, wherein the upper/lower stop flanges as well as the outward flange and upper/lower abutting edges of two-layer tear ring are of either annular or spaced patterns.

* * * * *